United States Patent [19]

Kerrigan

[11] Patent Number: 5,069,379

[45] Date of Patent: Dec. 3, 1991

[54] FASTENER DRIVING TOOL

[75] Inventor: James E. Kerrigan, Des Plaines, Ill.

[73] Assignee: Duo-Fast Corporation, Franklin Park, Ill.

[21] Appl. No.: 448,063

[22] Filed: Dec. 8, 1989

Related U.S. Application Data

[62] Division of Ser. No. 476,321, Mar. 17, 1983, Pat. No. 4,928,860.

[51] Int. Cl.[5] ..... B25C 1/06

[52] U.S. Cl. ..... 227/131; 227/120; 227/8

[58] Field of Search ..... 227/131, 120, 8

[56] References Cited

U.S. PATENT DOCUMENTS

| | | | |
|---|---|---|---|
| 4,042,036 | 8/1977 | Smith et al. | 227/131 X |
| 4,121,745 | 10/1978 | Smith et al. | 227/131 X |
| 4,129,240 | 12/1978 | Geist | 227/131 X |
| 4,189,080 | 2/1980 | Smith et al. | 227/131 X |
| 4,204,622 | 5/1980 | Smith et al. | 227/131 X |
| 4,298,072 | 11/1981 | Baker et al. | 227/131 X |
| 4,323,127 | 4/1982 | Cunningham | 227/131 X |

*Primary Examiner*—Paul A. Bell
*Attorney, Agent, or Firm*—Mason, Kolehmainen, Rathburn & Wyss

[57] ABSTRACT

A fastener driving tool of the type utilizing a motor driven energy storing flywheel and a reciprocating fastener driving ram employs a flywheel having a metal peripheral surface that selectively engages a metal surface of the ram in order to drive the ram into engagement with a fastener to be driven into a workpiece. An elastic cord returns the ram to a retracted position when the ram is disengaged by the flywheel, and a pair of elastic bumpers are employed to limit the travel of the ram in the direction of the retracted position and the direction of the fastener engaging position. The ram, bumpers and cords form a subassembly that permits the ram, cord and bumpers to be removed from the fastener as a unit. The cord is made relatively long to reduce the amount of stretch per unit length applied to the cord thereby to increase the life of the cord. The motor and flywheel may be rotated in opposite directions to reduce precessional forces.

21 Claims, 10 Drawing Sheets

136
137
91
86
90
94
48a
48
134
140
132
138
142
48b
118
120
46
122
106
50a
52
50
50b
44
88
84
92
89
18
12
100
14
10
117
118
106
44
48a
134
130
110
132
116
122
114
128
50a
124
48b
48
120
126
112
50
50b

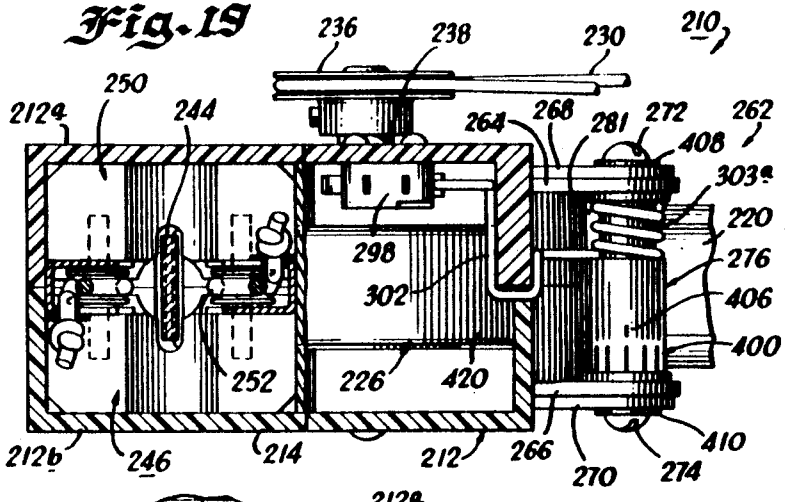
Fig. 19
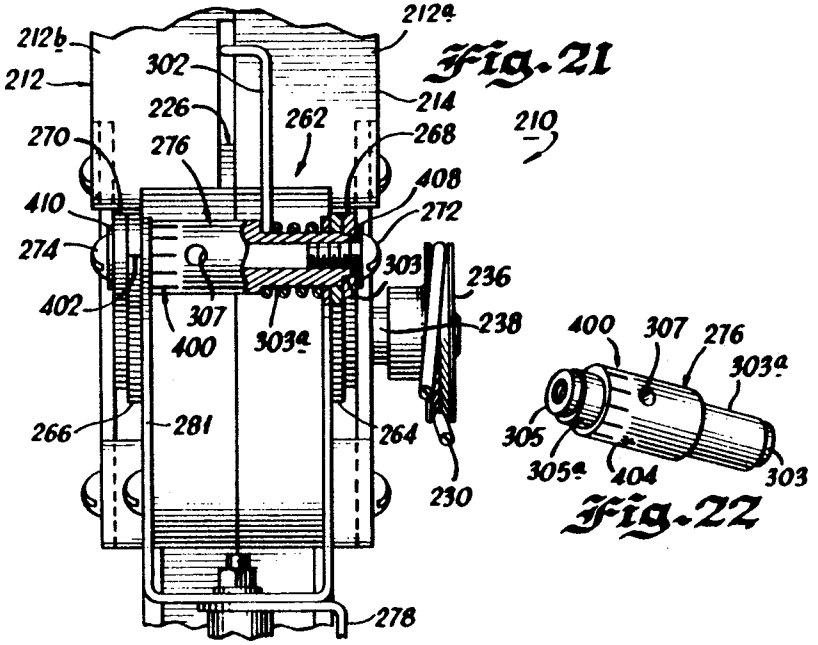
Fig. 21
Fig. 22
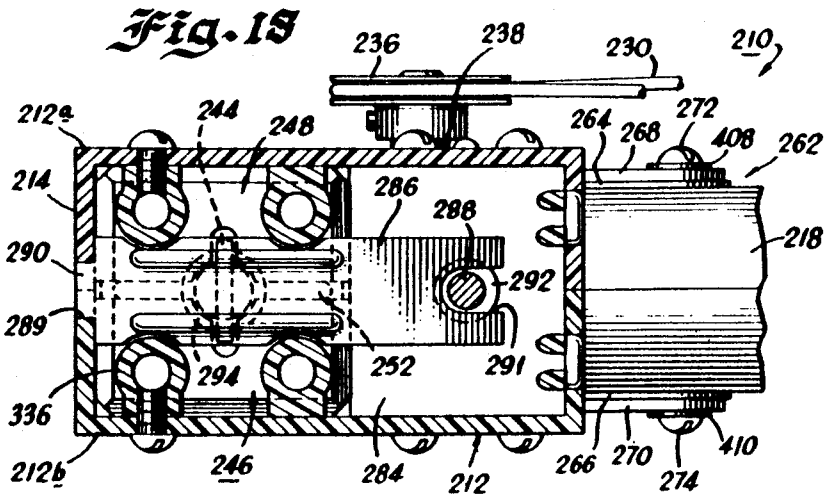
Fig. 18
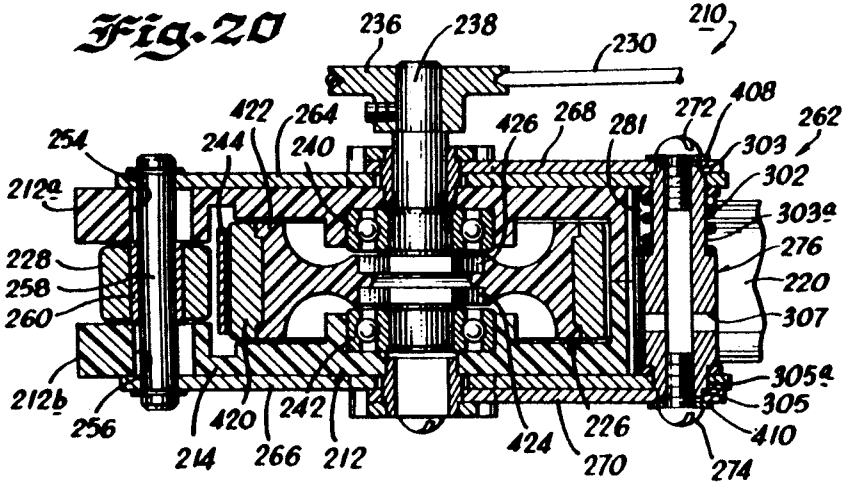
Fig. 20

218
210
212a
212b
212
219
224
230
234
232
220

428
430
318
244

426
238
424
422
420
226
337
336
286
291
290
292
288
294
284
212a
248
212b
218

289
318
246
300
212
244
252
214
210

336
212a
212
214
212b

FASTENER DRIVING TOOL

This is a division of application Ser. No. 06/476,321, filed Mar. 17, 1983, now U.S. Pat. No. 4,928,860.

BACKGROUND OF THE INVENTION

1. Field of the Invention

This invention relates generally to fastener driving tools, and particularly to driving tools that utilize an energy storing flywheel that selectively engages a ram in order to drive the ram into engagement with a fastener such as a nail or a staple in order to drive the fastener into the workpiece.

2. Description of the Prior Art

Several fastener driving tools that utilize an energy storing flywheel for the purpose of storing energy to drive the fastener into the workpiece are known. Examples of representative prior art devices are disclosed in U.S. Pat. Nos. 4,042,036; 4,121,745; 4,129,240; 4,189,080; 4,298,072; 4,290,493 and 4,323,127. While the devices disclosed in the above references are capable of driving fasteners such as nails or staples into a workpiece, they do suffer from several disadvantages, including excessive weight and less than optimum balance. These disadvantages present a particular problem in devices that employ more than one flywheel, especially those devices that utilize a separate motor to drive each of the two flywheels. In addition, the prior art devices utilize a high friction material such as brake lining or similar material that is disposed on the surface of the ram or on the periphery of the flywheel. Unfortunately, such material is subject to wear because of the high relative speed between the surface of the flywheel and the surface of the ram that is present when engagement occurs. Also, the high pressure exerted on the brake material causes the material to crumble prematurely. As a result, the ram or the flywheel must be frequently replaced. Also, in the prior art devices, neither the ram nor the flywheel is readily accessible, and consequently the replacement of these components tends to be time consuming and costly. Finally, the prior art devices utilize a resilient member for returning the ram to a rest position, and in the prior art devices, the resilient member tends to fatigue and fail after a moderate number of fasteners have been driven.

SUMMARY OF THE INVENTION

Accordingly, it is the object of the present invention to provide a fastener driving tool that overcomes many of the disadvantages of the prior art fastener driving tools.

It is yet another object of the present invention to provide a fastener driving tool that does not require a high friction material disposed on a surface of the ram or on the flywheel in order to effect energy transfer between the flywheel and the ram.

It is yet another object of the present invention to provide a fastener driving tool that utilizes a metal-to-metal contact between the flywheel and the ram to effect a transfer of energy between the flywheel and the ram.

It is yet another object of the present invention to provide a fastener driving tool wherein the contact pressure between the flywheel and ram may be readily adjusted to compensate for component wear and for manufacturing tolerances.

It is yet another object of the present invention to provide a fastener driving tool having a slightly resilient flywheel to optimize the contact pressure between the flywheel and ram.

It is yet another object of the present invention to provide a fastener driving tool having a flywheel that has a central portion fabricated from a relatively light material and a rim fabricated from a heavier material to provide a lightweight flywheel capable of storing as much energy as a heavier flywheel fabricated from a single material.

It is yet another object of the present invention to provide a fastener driving tool that is relatively light, compact and well balanced.

It is yet another object of the present invention to provide a fastener driving tool wherein the components that are subject to the most wear are readily removable and replaceable.

It still another object of the present invention to provide an assembly containing a ram, a travel limiting supporting structure and an elastic member that maintains the ram at one end of its travel that is readily removable from the fastener driving tool as a unit.

It is yet another object of the present invention to provide a single motor, single flywheel fastener driving tool having the motor and flywheel spaced from each other so as to provide a well-balanced tool.

It is yet another object of the present invention to provide a single motor, single flywheel fastener driving tool wherein the precessional forces caused by the rotating masses are minimized.

It is yet another object of the present invention to provide an improved fastener driving tool that can be battery powered.

It is yet another object of the present invention to provide a fastener driving tool wherein the major wear components have a longer life than those of the prior art devices.

Therefore, in accordance with a preferred embodiment of the invention, there is provided a fastener driving tool that employs an energy storing flywheel having a metal peripheral surface, preferably steel, that is driven by an electric motor at a speed sufficient to store enough energy to drive a fastener, such as a nail or a staple, into a workpiece. A light weight ram that has a metal surface, preferably steel, is reciprocably mounted adjacent to the peripheral surface of the flywheel. An idler wheel and a toggle mechanism are utilized selectively to bring the metal surface of the ram into contact with the peripheral surface of the flywheel, thereby to cause a transfer of energy from the flywheel to the ram in order to propel the ram into engagement with a fastener. The toggle mechanism utilizes an eccentric member to adjust the contact pressure between the ram and flywheel to compensate for manufacturing tolerances and component wear.

The ram is mounted within a supporting structure that contains bumpers at opposite ends thereof for limiting the travel or excursion of the ram. A resilient member, preferably an elastic shock cord, is also mounted within the supporting structure and serves to retain the ram at one of the limits of its travel when the ram is not being engaged by the flywheel. The shock cord is supported on four pulleys so that a longer shock cord than is utilized in the prior art devices may be employed, thereby to reduce the amount of stretch that occurs along any portion of the cord. The assembly containing the ram, bumpers and elastic cord is mounted within the fastener driving device in a manner to permit the assembly to be readily removed as a unit and replaced by a similar assembly in the event of wear or damage to the ram, bumpers or elastic member.

The electric motor used to drive the flywheel is mounted to the fastener driving tool in a spaced relationship from the flywheel in order to distribute the weight of the major components throughout the fastener housing to thereby provide a well-balanced tool. Power is transferred from the motor to the flywheel via a resilient belt interconnecting a pair of pulleys, one attached to the shaft of the motor and another attached to the flywheel. Moreover, if desired, the flywheel and the motor can be made to rotate in opposite directions to thereby minimize the precessional forces caused by the rotating masses of the flywheel and motor armature. In addition, the flywheel may be fabricated from two different materials, with the central portion of the flywheel being fabricated from a relatively light, resilient material, such as plastic, and the rim can be fabricated from a heavier, more durable material, such as steel. This combination has two advantages. Firstly, the use of a light material at the center of the flywheel and a heavier material at its rim permits a lighter weight flywheel having the same energy storage capability as a heavier flywheel fabricated from a single material to be achieved. Secondly, the resiliency of the hub portion permits optimum contact pressure between the flywheel and the ram to be more readily achieved by making contact pressure less critical of component tolerances.

Because the energy required to drive the fastener is stored in the flywheel, the peak power requirements imposed on the motor are relatively low. Consequently, a relatively small battery-powered motor may be employed to drive the flywheel in the event that a portable tool is desired.

DESCRIPTION OF THE DRAWING

These and other objects and advantages of the present invention will become apparent upon consideration of the following detailed description and attached drawing wherein:

FIG. 2 is a front elevational view of the fastener driving tool according to the invention;

FIG. 18 is a sectional view taken along line 18—18 of FIG. 16 showing the top of the ramp supporting structure;

FIG. 19 is a cross sectional view taken along line 19—19 of FIG. 16;

FIG. 20 is a sectional view taken along line 20—20 of FIG. 16;

FIG. 21 is a sectional view taken along line 21—21 of FIG. 16 illustrating the toggle assembly in greater detail;

FIG. 22 is a perspective view of the eccentric spacer of the toggle assembly;

DETAILED DESCRIPTION OF THE PREFERRED EMBODIMENT

Figures 1, 7, 13:
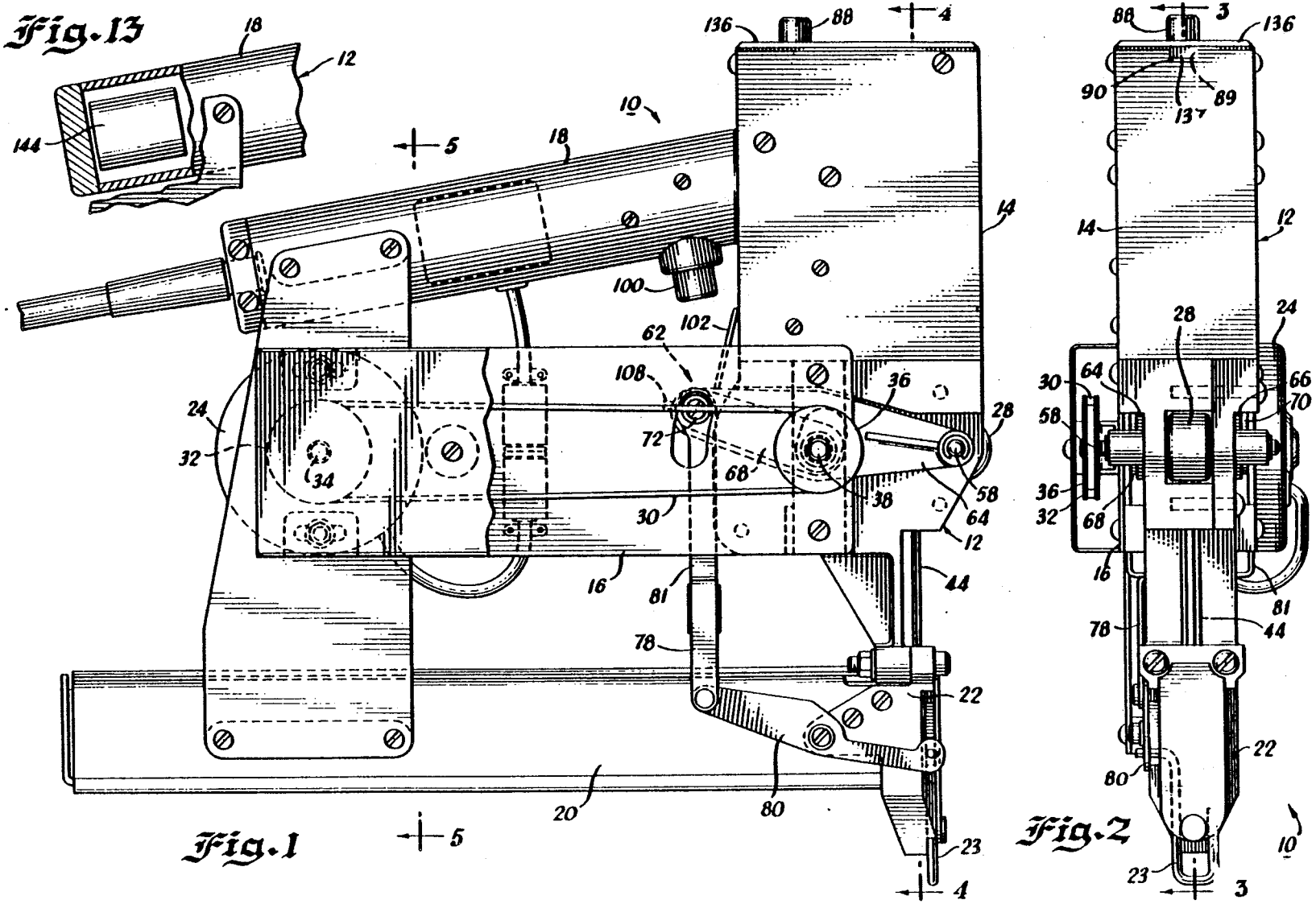
FIG. 1 is a left side elevational view of the fastener driving tool according to the invention.
FIG. 7 is a cross-sectional view taken along line 7—7 of FIG. 3 showing the top of the ram supporting structure.
FIG. 13 is a partial cross-sectional view of the handle of a fastener driving tool utilizing a battery power source.

Referring now to the drawing, with particular attention to FIGS. 1 and 2, there is shown a fastener driving tool according to the present invention generally designated by the reference numeral 10. The fastener driving tool illustrated in FIG. 1 includes a housing 12 which has a vertical portion 14 and a horizontal portion 16. A handle 18 is affixed to the housing 12, as is a magazine 20 which contains the fasteners to be driven. In the illustrated embodiment, the magazine 20 is designed to hold U-shaped staples, but other suitable magazines, such as those designed to hold nails or other fasteners, may be used with appropriate modifications to the fastener driving tool.

The fastener driving tool also includes a nosepiece 22, an electric motor 24, which may powered either from an AC mains source or a battery power source, an energy storing flywheel 26 (best shown in FIG. 3) and an idler wheel 28. A safety yoke 23, whose function will be described in a subsequent portion of the specification, is disposed within and adjacent the nosepiece 22. A drive belt 30 interconnects a pulley 32, affixed to a shaft 34 of the motor 24, and a second pulley 36, affixed to a shaft 38 of the flywheel 26, and serves to rotate the flywheel 26 whenever the motor 24 is energized.

The shaft 38 of the flywheel 26 is supported within the housing 12 by a pair of bearings 40 and 42 (FIG. 9) which may be ball bearings, needle bearings or other suitable bearings. A fastener driving member or ram 44 is supported within the housing 12 by a subassembly 46 (FIGS. 3, 4 and 10) located within the upper housing 14. The subassembly 46 includes an upper travel limiting bumper 48 and a lower travel limiting bumper 50 that serve to limit the upward and downward travel, respectively, of the ram 44. An elastic member, preferably an elastic shock cord 52, sometimes known as a Bungee cord, is fabricated from a plurality of elastic fibers bundled together, and serves to bias the ram 44 in its uppermost position.

The idler wheel 28 is supported within two slots 54 and 56 (FIGS. 3 and 9) of the housing 12 by a shaft 58. A bearing 60, which may be a needle bearing or a sleeve bearing fabricated from bronze or other suitable material, permits the idler wheel 28 to rotate freely about the shaft 58. The idler wheel shaft 58 is moved laterally within the slots 54 and 56 by a toggle mechanism 62 (FIGS. 1, 3, 8 and 9) that includes a pair of arms 64 and 66 that support the shaft 58, and a pair of shorter arms 68 and 70 that are pivotably mounted about the axis of the shaft 38. The arms 64 and 68 are connected together at one end by a screw 72, and the arms 66 and 70 are connected together by a similar screw 74. A spacer 76 receives the screws 72 and 74, and serves to maintain the arms 64, 66, 68 and 70 in a spaced parallel relationship about the flywheel 26, and as will be explained in a subsequent portion of the specification, also serves to adjust the contact pressure between the flywheel 26 and the ram 44.

Figure 3:
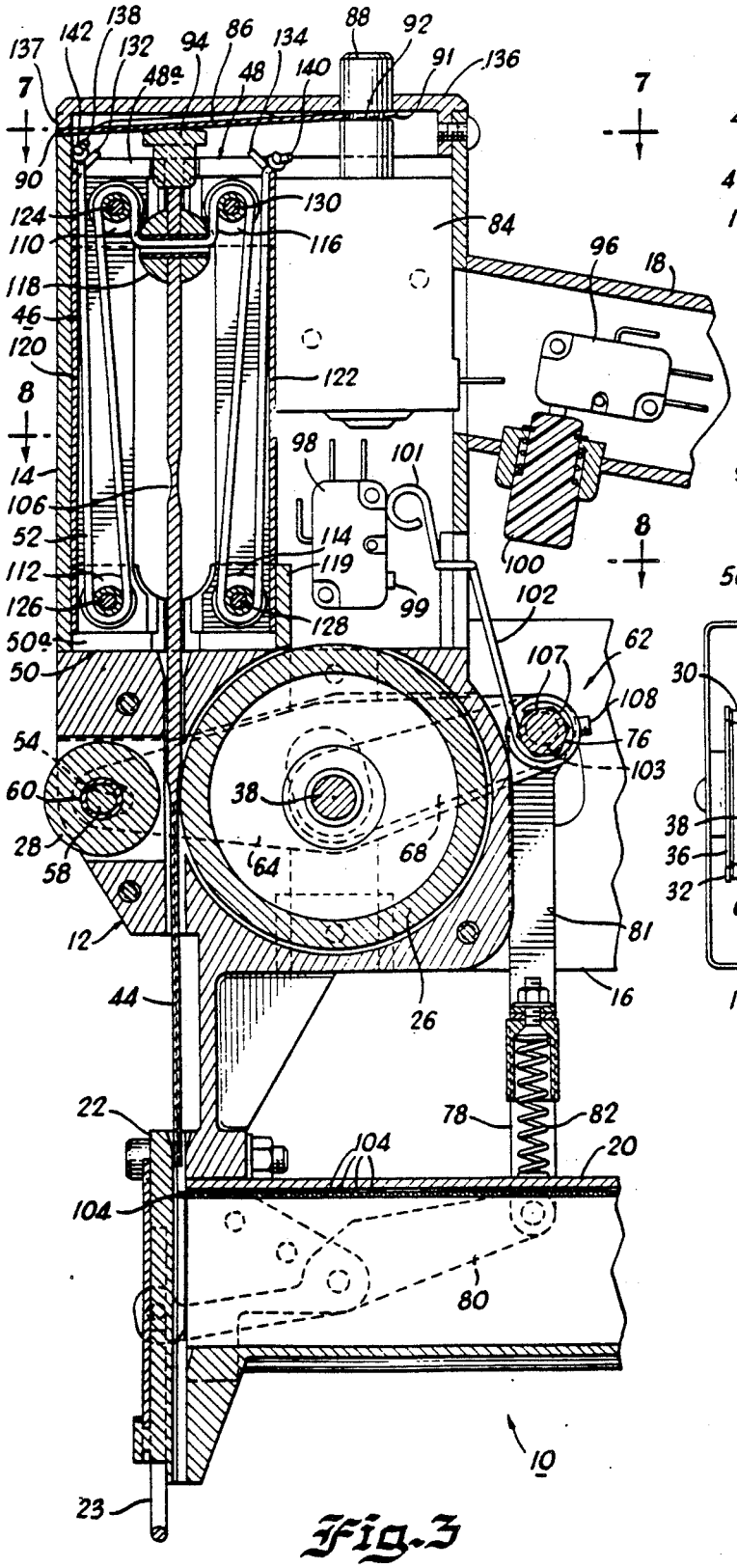
FIG. 3 is a cross-sectional view taken along line 3—3 of FIG. 2.
Figure 4:
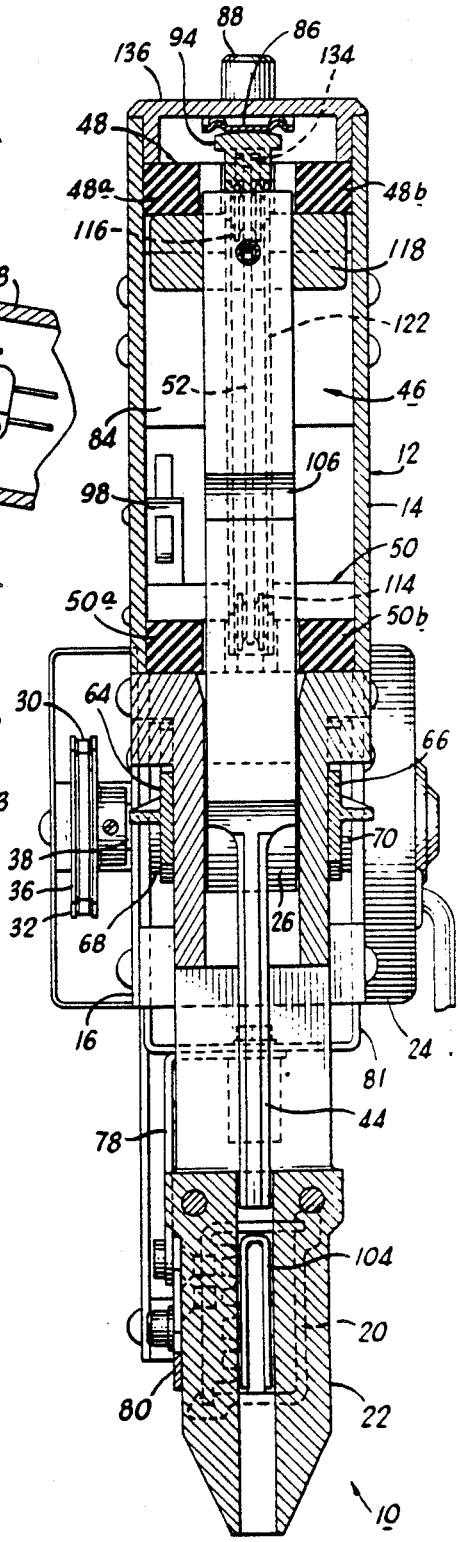
FIG. 4 is cross-sectional view taken along line 4—4 of FIG. 1.
Figures 5, 6, 12:
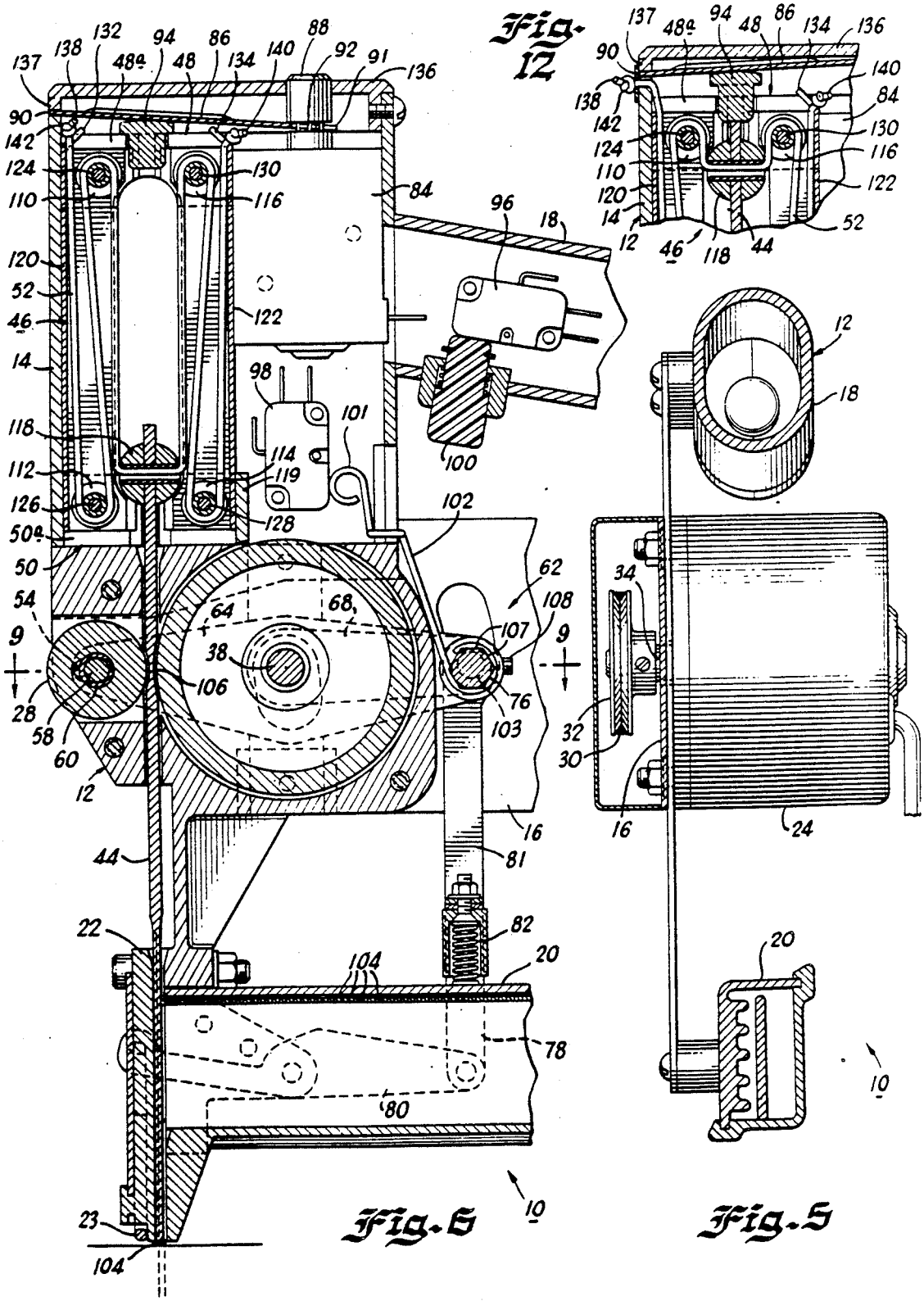
FIG. 5 is a cross-sectional view taken along line 5—5 of FIG. 1 showing the mounting of the flywheel drive motor.
FIG. 6 is a cross-sectional view similar to FIG. 3 showing the drive ram in its lowermost position.
FIG. 12 is a partial cross-sectional view showing an alternative mounting of the elastic member within the fastener housing.
Figure 7:
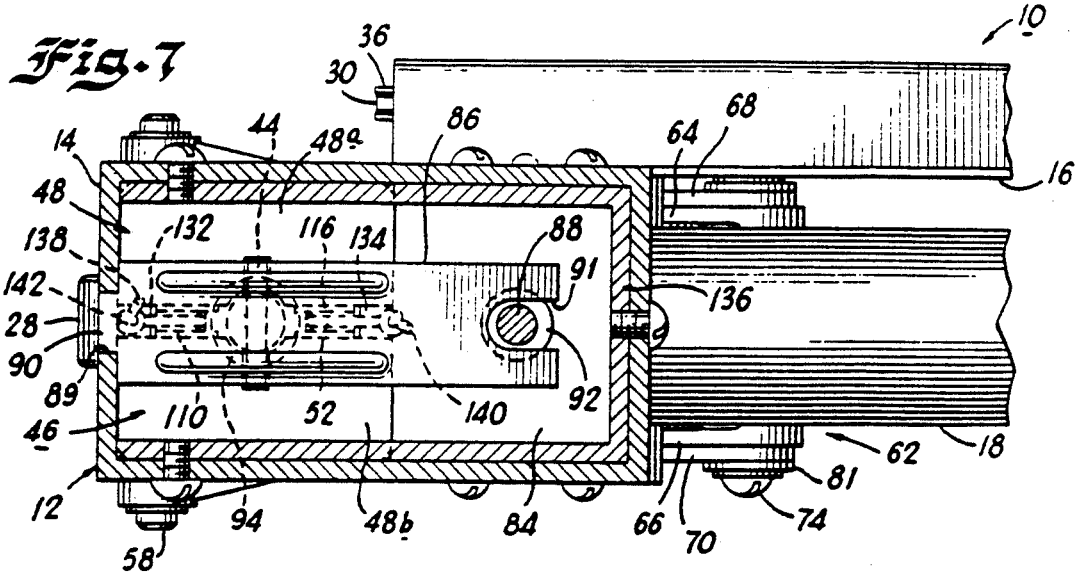
Figure 8:
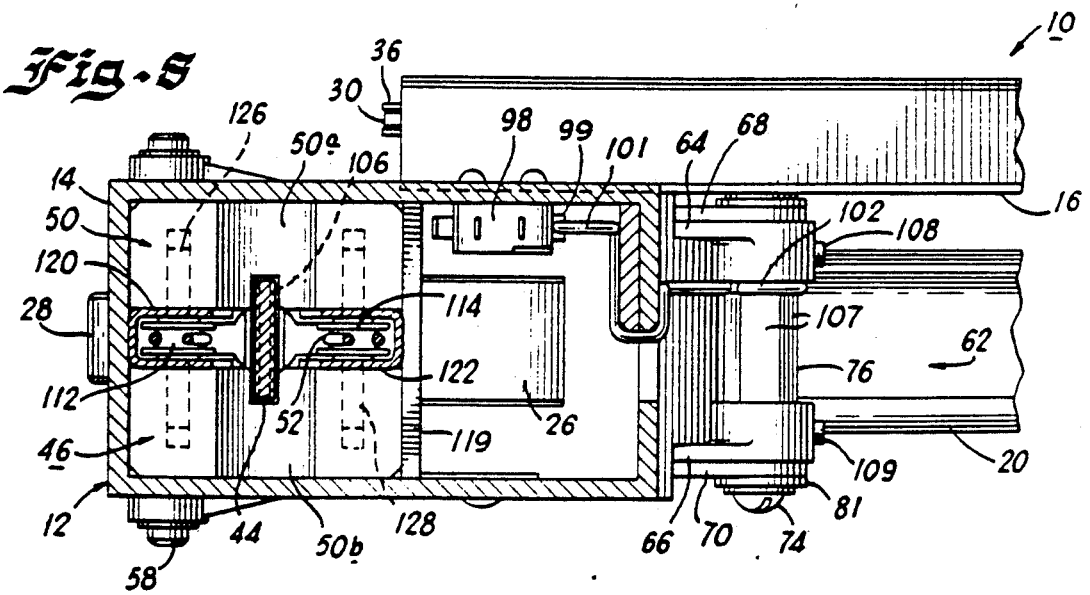
FIG. 8 is a cross-sectional view taken along line 8—8 of FIG. 3 showing the construction of the ram supporting structure.

A linkage employing a pair of lever arms 78 and 80 and a U-shaped member 81 (FIGS. 1 and 3) couples the safety yoke 23 to the toggle mechanism 62 at opposite ends of the spacer 76, and causes the toggle mechanism 62 to be toggled from the position shown in FIGS. 1 and 3 to the position shown in FIG. 6 when the nosepiece 22 and the safety yoke 23 are brought into contact with a workpiece. A resilient member, such as, for example, a spring 82, returns the toggle mechanism 62 to the position shown in FIGS. 1 and 3 when the tool is disengaged from the workpiece.

A solenoid 84 is mounted within the vertical housing 14 and actuates a lever 86 via a solenoid armature 88. A reduced width end 90 of the lever 86 is retained in a slot 89 of the vertical portion 14 of the housing 12. A U-shaped notch 91 at the other end of the lever 86 engages a groove 92 in the solenoid armature 88. A cap 94 is interposed between the lever 86 and the upper part of the ram 44 in order to mechanically couple the lever 86 to the ram 44 so that energization of the solenoid 84, which causes the armature 88 to retract into the solenoid 84, will cause the ram 44 to be pushed down by the cap 94.

A pair of switches 96 and 98 controls the operation of the solenoid. The switch 96 is controlled by a manually actuated trigger or push button 100, while the switch 98 is controlled by the safety yoke 23 via the levers 78 and 80, a U-shaped member 81 and a wire link 102. The wire link 102 has one end coupled to the spacer 76 and another end 101 disposed adjacent the switch 98, and serves to depress a button 99 on the switch 98 when the safety yoke 23 is brought into contact with a workpiece. The switches are wired so that the solenoid 84 may be energized only if the push button 100 is depressed, and the safety yoke 23 is depressed by the workpiece.

In operation, the flywheel 26 is rotated by the motor 24 in a direction to force the ram 44 downwardly when it is engaged by the flywheel 26. The motor may be energized either by depressing the push button 100, or by turning on a separate on-off switch (not shown) which may be located at any convenient location on the housing 12 or handle 18. In the preferred embodiment, the flywheel 26, the idler wheel 28 and the ram 44 are fabricated from metal, preferably steel, to give a metal-on-metal, preferably steel-on-steel, contact between the ram 44, the flywheel 26 and the idler wheel 28. A steel particularly suitable for the flywheel 26 is high carbon, chrome steel, such as type D-2 or 52100 tool steel.

It has been found that for steel-on-steel contact, in the present embodiment, the optimum speed of rotation of the wheel 26 is that rotational speed which results in a tangential velocity of approximately 120 feet per second at the periphery of the wheel 26. The tangential velocity of 120 feet per second has been selected as a suitable compromise between he amount of energy that can be stored in the flywheel 26 and the durability of the flywheel 26 and ram 44. Because the amount of energy that can be stored in the flywheel 26 is a function of its mass and the square of its speed of rotation, it is desirable to make the speed of rotation as high as possible in order to minimize the size and weight of the flywheel 26 required to drive a certain size fastener. However, above a tangential velocity of 120 feet per second, the surface of the flywheel 26 tends to slip when it engages the ram 44, thus causing frictional heating and burning at the point of contact, particularly at the surface of the ram 44. Such burning reduces the life of the ram 44 and eventually damages the peripheral surface of the flywheel 26.

Accordingly, in the present device, the tangential velocity of the periphery of the flywheel 26 is limited to approximately 120 feet per second. In the present embodiment, the diameter of the flywheel 26 is approximately 2.7 inches, and in order to achieve the speed of 120 feet per second at the periphery of the flywheel 26, the flywheel 26 is rotated at approximately 10,500 rpm.

When the safety yoke 23 is not in contact with a workpiece, the toggle mechanism 62 is positioned as is shown in FIG. 3 to maintain the flywheel 26 and the idler wheel 28 in a spaced apart relationship, with the spacing between the flywheel 26 and the idler wheel 28 being greater than the thickness of the ram 44. Consequently, in this condition, no energy can be imparted to the ram 44, even when the flywheel 26 is rotating. When the nosepiece 22 is brought into contact with a workpiece, the safety yoke 23 is raised, and the member 81 moves downwardly from the position shown in FIG. 3 to the position shown in FIG. 6 to pivot the arms 68 and 70 in a clockwise direction about the shaft 38. This, in turn, moves the arms 64 and 66 downwardly and to the right to the position shown in FIG. 6, thereby moving the idler 28 closer to the flywheel 26. However, because the lower portion of the ram 44 is of reduced thickness, the flywheel 26 does not engage the ram 44 as long as the ram 44 is in its uppermost position.

Engagement only occurs after the solenoid 84 has been energized to push the ram 44 down enough to position the thicker portion of the ram 44 between the flywheel 26 and the idler wheel 28. This energization of the solenoid 84 results only when the push button 100 closes the switch 96, and the switch 98 is closed by the rod 102 when the safety yoke 23 is brought into contact with a workpiece as is shown in FIG. 6. When this occurs, the ram 44 is driven downward and into engagement with a fastener 104 within the magazine 20, and drives the fastener into the workpiece. When driving the fastener 104, the ram 44 is driven downward until it reaches its lowermost position, at which position a reduced thickness section 106 is interposed between the flywheel 26 and the idler wheel 28 (FIG. 6). This causes a temporary disengagement of the ram 44 and the flywheel 26, and prevents friction damage to the surface of the flywheel 26 or to the ram 44 when the ram 44 is in its downwardmost position prior to the disengagement of the workpiece by the nosepiece 22 and safety yoke 23. In practice, the position illustrated in FIG. 6 is only an instantaneous position because the impact that occurs when the fastener 104 is driven into the workpiece causes the fastener driving tool to be kicked upward. When this occurs the nosepiece 22 and safety yoke 23 are disengaged from the workpiece, and the toggle mechanism 62 returns to the position illustrated in FIG. 3, thereby again increasing the spacing between the flywheel 26 and the idler wheel 28 to a value greater than the thickness of the ram 44.

In order to compensate for manufacturing tolerances, to assure that optimum pressure is applied to the ram 44 during engagement by the flywheel 26 so that excessive slippage does not occur, and to compensate for wear of the ram 44 and the flywheel 26, the toggle mechanism 62 is provided with a mechanism for readily adjusting the spacing between the flywheel 26 and the idler wheel 28. The adjusting mechanism can be adjusted in the factory to compensate for variations occurring in the manufacturing process and also in the field to compensate for wear, and includes a pair of eccentric end portions 103 and 105 (FIG. 9) disposed at opposite ends of the spacer 76. Alternatively, the end portions 103 and 105 can be made concentric with the axis of the spacer 76, and the portions 103*a* and 105*a* of the spacer 76 engaging the arms 64 and 66 made eccentric. Such a system is described in a subsequent portion of the specification describing an alternative embodiment of the tool according to the invention. The eccentric end portions 103 and 105 engage the shorter arms 68 and 70, respectively, and serve to move the longer arms 64 and 66 with respect to the shorter arms 68 and 70, and consequently, the idler wheel 28 with respect to the flywheel 26, as the spacer 76 is rotated about its axis. A series of flats 107 are formed on the central portion of the spacer 76 to permit the spacer 76 to be rotated by a wrench or other similar tool. To adjust the spacing between the flywheel 26 and the idler wheel 28, the portion of the armature 88 extending from the housing may be manually depressed to bring the thicker portion of the ram 44 between the flywheel 26 and the idler wheel 28, and the spacer 76 is rotated until the ram 44 is gripped firmly between the flywheel 26 and idler wheel 28. A pair of set screws 108 and 109 are provided to prevent the spacer 76 from rotating after the desired spacing between the flywheel 26 and the idler wheel 28 has been achieved.

The ram 44 is supported between the upper bumper 48 and the lower bumper 50 by the elastic shock cord 52 which passes over four pulleys 110, 112, 114 and 116 (FIGS. 3 and 6), and through the ram 44 and through a lateral crosspiece or travel limiting stop member 118 secured near the top of the ram 44 by a hollow eyelet 117. The shock cord 52 causes the ram 44 to be returned from the position shown in FIG. 6 to the position shown in FIG. 3 when the toggle mechanism 62 is toggled to the spaced apart position shown in FIG. 3.

When the ram 44 is engaged by the flywheel 26, the ram 44 is accelerated very rapidly, and the transition from the position shown in FIG. 3 to the position shown in FIG. 6 is almost instantaneous, for example, on the order of approximately 0.005 to 0.01 seconds. Such rapid acceleration puts a severe strain on any resilient device that is utilized to return the ram to its upward position. For this reason, and in accordance with another important aspect of the present invention, the elastic shock cord 52 is made relatively long to minimize the amount of stretch that occurs along any given section of the shock cord 52.

By passing the shock cord 52 over the four pulleys 110, 112, 114 and 116, the length of the shock cord in its unstretched condition is approximately four times the length of travel of the ram 44, and as a result, the shock cord 52 is lengthened only by approximately 50% of its original length when the ram 44 is moved from its uppermost position to its lowermost position. This results in a substantial increase in the life of the shock cord when compared to prior art systems that require the resilient device to be stretched 100% or more. Moreover, the use of a light weight all metal ram permits the ram 44 to be rapidly accelerated and easily stopped by the bumpers 48 and 50 at the limits of travel.

Figures 10, 11:
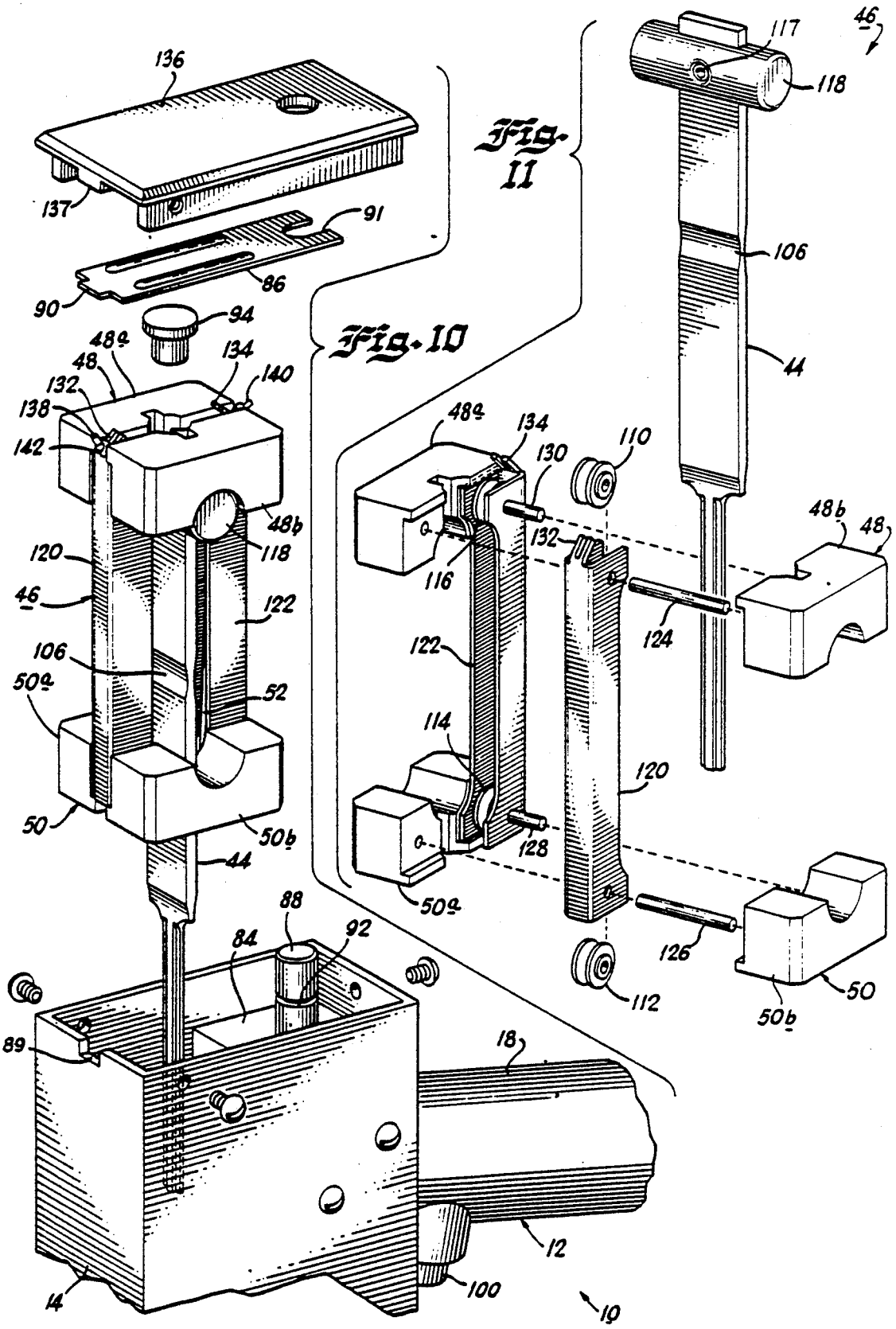
FIG. 10 is an exploded perspective view showing the ram supporting assembly.
FIG. 11 is an exploded perspective view showing the ram supporting assembly in greater detail.

In accordance with another important aspect of the present invention, the ram 44 and its supporting structure 46, including the upper and lower bumpers 48 and 50, respectively, the shock cord 52 and the pulleys 110, 112, 114 and 116 are conveniently fabricated as a single unit. The supporting structure 46 is positioned within the upper portion 14 of the housing 12 by three walls of the upper portion 14, the solenoid 84 and a wall 119, and is readily removable from the vertical portion 14 of the housing 12. As is best illustrated in FIGS. 10 and 11, the upper and lower bumpers 48 and 50 are each fabricated as two halves 48*a*, 48*b* and 50*a*, 50*b*, respectively. The bumpers 48 and 50 are separated by a pair of U-shaped vertical support members 120 and..122. The vertical support members 120 and 122 contain the four pulleys 110, 112, 114 and 116 which are supported by four shafts 124, 126, 128 and 130, each of which protrudes beyond the vertical support members 120 and 122. The protruding sections of the shafts 124, 126, 128 and 130 serve as convenient supports for the upper and lower bumper halves 48*a*, 48*b* and 50*a*, 50*b* which contain apertures to receive the shafts 124, 126, 128 and 130. The shafts 124, 126, 128 and 130 are retained in the apertures of the bumper halves 48*a*, 48*b*, 50*a* and 50*b* by a press fit. The ends of the elastic shock cord 52 are supported, for example, by a pair of bifurcated supports 132 and 134 located at the tops of the vertical support members 120 and 122, respectively.

As can be seen from FIGS. 10 and 11, the ram 44, the bumpers 48 and 50 and the elastic shock cord together with the pulleys 110, 112, 114 and 116 and the vertical support members 120 and 122 form a self-contained assembly 46 that can readily be inserted into and removed from the vertical portion 14 of the housing 12. This is an important feature because the ram 44, the bumpers 48 and 50 and the shock cord 52 are the components that are most susceptible to wear in a flywheel type fastener driving tool. Thus, the removability of the assembly 46 allows ready replacement of the most wear-prone components in the field without the need for substantially disassembling the device. Moreover, the simple construction of the assembly 46, which uses four identical bumper sections, four identical pulleys, four identical shafts and two identical vertical support members permits ready replacement of the ram 44, shock cord 52 and any other worn components without the need for stocking a large number of different replacement parts. As a result, the assembly 46 can readily be repaired or remanufactured with a minimum of effort, either in the field or at a repair station.

In addition, the illustrated structure provides a way conveniently to adjust the tension of the shock cord 52. The ends 138 and 140 of the elastic shock cord are exposed by removing a cover 136, which also releases the reduced width end 90 of the lever 86 that is retained within the notch 81 by a protrusion 137 of the cover 136. By simply stretching one of the ends, and repositioning one of the knots such as a knot 142 at the end of the shock cord 52, the tension of the shock cord 52 can be adjusted to compensate for wear or to adjust the tension for different applications. In an alternative embodiment (FIG. 12), the elastic shock cord 52 may be passed through a wall of the vertical portion 14 of the housing, and the knot 142 positioned outside of the housing to permit the tension of the shock cord 52 to be adjusted without removing the top cap 136. The positioning of the knot 142 outside of the housing 14 need not affect the removability of the assembly 46 as a unit, since the knot 142 can be readily unfastened, or alternatively, the cord 52 can be supported in a slot in the vertical portion 14 of the housing and retained in position by the cap 136. In such an instance, removal of the cap 136 will expose the top of the slot and permit ready disengagement of the shock cord 52 from the wall of the housing 12.

Since the energy required to drive a fastener into a workpiece is stored within the flywheel 26, the size and peak power capability of the motor 24 is relatively unimportant. Because the energy is stored within the flywheel 26, the use of a smaller motor will not affect the size of the fastener that can be driven into the workpiece, but will simply affect the rate at which the fasteners can be driven. This is because when a smaller motor is used, it will simply take more time for the flywheel 26 to be driven to a speed sufficient to drive the fastener, but once that speed is attained, the energy stored within the flywheel 26 will be the same as if a larger motor had been used.

The lack of a high peak power requirement even permits a battery-powered motor to be used as the motor 24. For example, it has been found that by using a portable battery, such as a battery 144 (FIG. 13), and mounting the battery in the handle 18, a completely portable tool can be provided.

Mounting the motor 24 (and battery 144, when used) near the rear of the tool serves to balance the weight of the flywheel 26 mounted near the front of the tool, and results in a well-balanced tool. In addition, the use of the relatively long belt 30 provides a degree of resiliency in the power coupling between the motor 24 and the flywheel 26, and results in a decrease in the shock applied to the motor 24 when the ram 44 is engaged by the flywheel 26. Such a resilient transmission reduces the slow down of the shaft of the motor 24 when the ram 44 engages the flywheel 26.

Figures 14, 15:
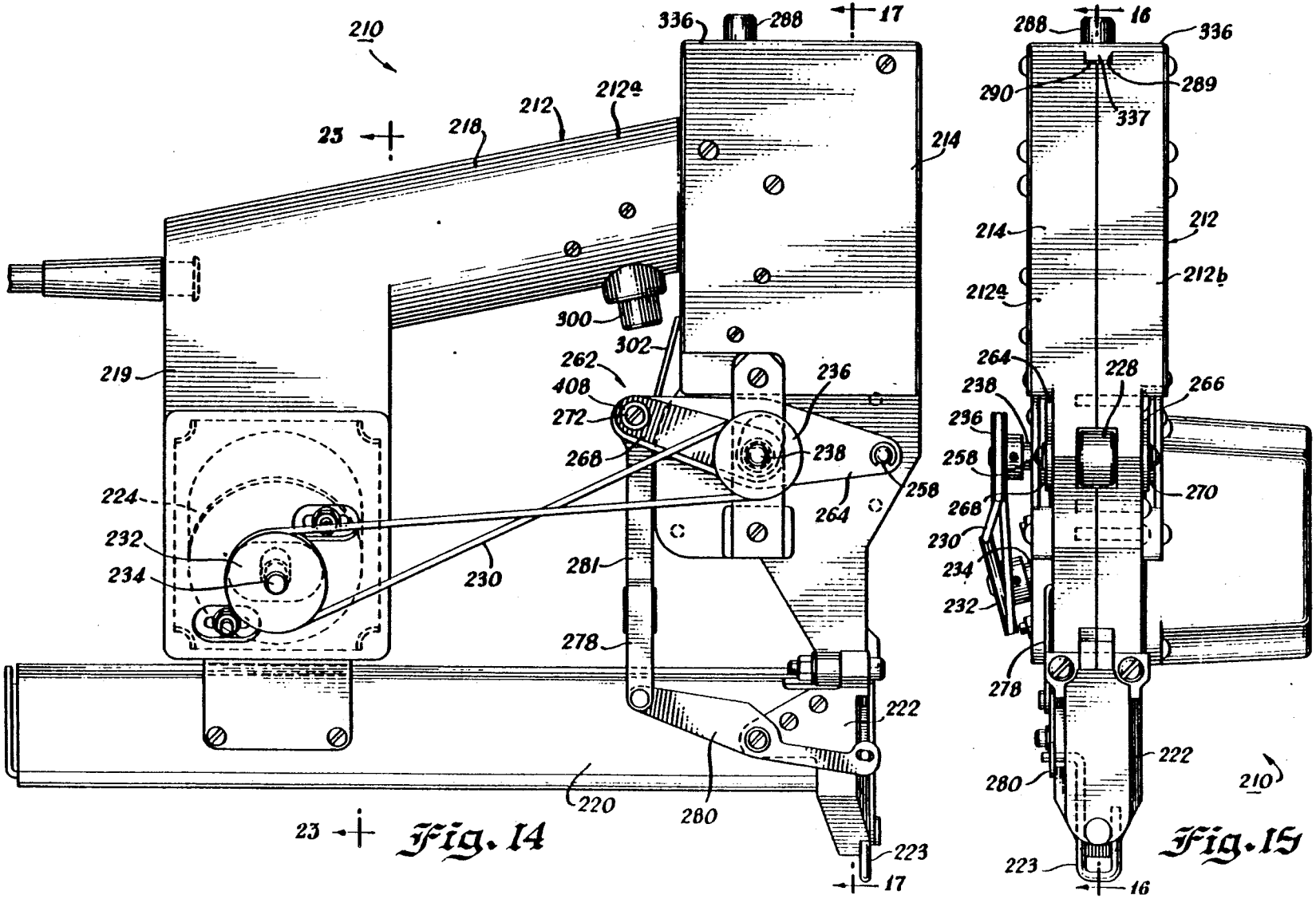
FIG. 14 is a left side elevational view of another embodiment of the fastener driving tool according to the invention.
FIG. 15 is a front elevational view of the fastener driving tool illustrated in FIG. 14.

Referring now to FIG. 14, there is shown another embodiment of the fastener driving tool, shown generally as 210, according to the invention. The features of the embodiment illustrated in FIG. 14 are similar to those of the embodiments illustrated in FIG. 1, and consequently, the various components of the embodiment illustrated in FIG. 14 will be assigned reference numerals that are 200 higher than corresponding components in the embodiment of FIG. 1.

The fastener driving tool illustrated in FIG. 14 includes a housing 212 which has a handle 218, a forward vertical portion 214 disposed at one end of the axis of elongation of the handle 218, and a rearward vertical portion 219 disposed at the other end of the axis of elongation of the handle 218. In the embodiment illustrated, the housing 212 may be conveniently fabricated in two halves **212*a* and 212*b* (FIG. 15), and one half of the forward vertical portion 214 as well as one half of the rearward vertical portion 219 is formed integrally with each of the halves 212*a* and 212*b* of the housing 212. The housing 212 may be fabricated from any suitable lightweight, high strength material, and it has been found that a high impact plastic is suitable for this purpose. A magazine 220 similar to the magazine 20 is affixed to the housing 212 and is provided with a nosepiece 222. An electric motor 224, similar to the motor 22 is attached to the rearward vertical portion 219 of the housing 212 below the axis of elongation of the handle 218. An energy storing flywheel 226 (best shown in FIG. 16) and an idler wheel 228 which cooperate with an impact element, or ram 244 to provide an impact means, are mounted within the forward vertical portion 214 of the housing 212 on the same side of the axis of elongation of the handle 218 as is the motor 224. Such mounting of the motor 224 and the flywheel 226 at opposite ends of the axis of elongation of the handle 218, and below the axis, results in a well-balanced tool. A safety yoke 223 is disposed within and adjacent the nosepiece 222. A pulley 232 is affixed to a shaft 234 of the motor 224, and a second pulley 236 is affixed to a shaft 238 of the flywheel 226. A drive belt 230 interconnects the pulleys 232 and 236 and serves to rotate the flywheel 226 whenever the motor 224** is energized.

In accordance with another important aspect of the present invention, counterrotating rotor means, are provided to at least partially reduce the precessional forces generated by the rotating flywheel 226. In the illustrated embodiment, the armature and shaft 234 of the motor 224 rotate in a direction opposite the direction of rotation of the flywheel 226 and serve as the counterrotating rotor means. Thus, the counterrotating mass of the armature of the motor 224 tends to cancel the precessional forces generated by the rotating flywheel 226.

Although various drive mechanisms, such as, for example, gears or friction coupled drive wheels, are suitable for producing counterrotation, it has been found that counterrotation can be simply and effectively produced by simply connecting the belt 230 between the pulleys 232 and 236 in a figure-eight pattern as is illustrated in FIG. 14. In order to prevent the oppositely traveling portions of the belt 230 from interfering with each other, the axis of the motor 224 is tilted with respect to the axis of the flywheel 226 (best shown in FIGS. 15 and 23) to maintain the oppositely traveling portions of the belt 230 in a spaced relationship from each other.

Figure 9:
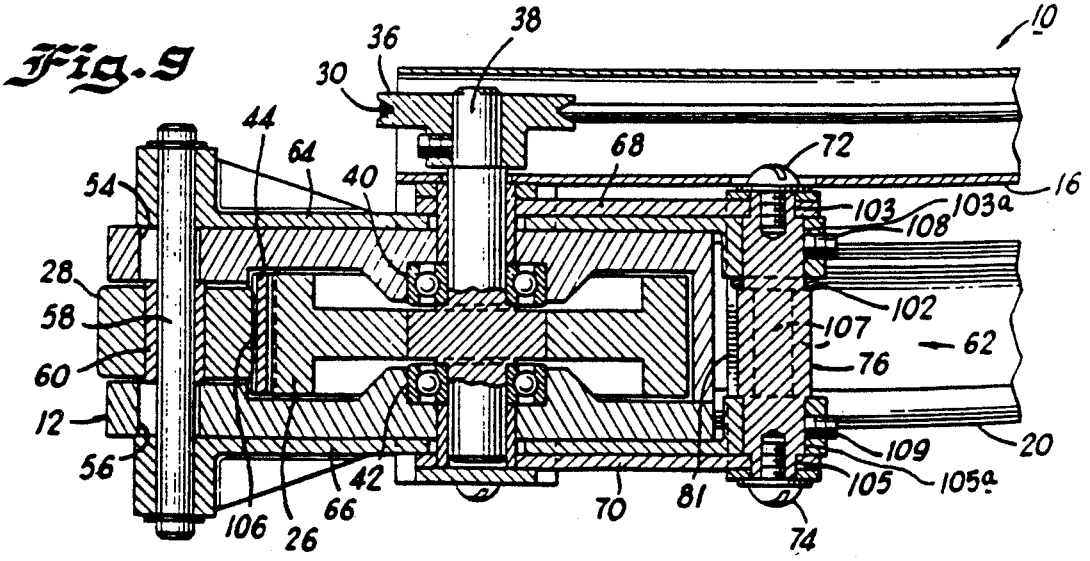
FIG. 9 is a cross-sectional view taken along line 9—9 of FIG. 6 showing the flywheel and idler wheel mechanism.

The shaft 238 and the flywheel 226 are supported within the housing 212 by a pair of bearings 240 and 242 (FIG. 20) which may be similar to the bearings 40 and 42 (FIG. 9). A fastener driving member or ram 244 is supported within the housing 212 by a subassembly 246 (FIGS. 16 and 25) similar to the subassembly 46. The subassembly 246 includes upper and lower bumpers 248 and 250, respectively, and an elastic shaft cord 252 is utilized to bias the ram 244 in its uppermost position.

As in the case of the previously described embodiment, the idler wheel 228 is supported within two slots 254 and 256 (FIGS. 15, 16 and 20) of the housing 212 by a shaft 258. A bearing 260, similar to the bearing 60, permits the idler wheel 228 to rotate about the shaft 258. The idler wheel shaft 258 is moved laterally within the slots 254 and 256 by a toggle mechanism 262 (FIGS. 14, 16, 19, 20 and 21), similar to the toggle mechanism 62. The toggle mechanism 262 includes a pair of arms 264 and 266 that support the shaft 258, and a pair of shorter arms 268 and 270 that are pivotably mounted about the axis of the shaft 238. The arms 264 and 268 are connected together at one end by a screw 272, and the arms 266 and 270 are connected together by a screw 274. A spacer 276 receives the screws 272 and 274, and as in the case of the spacer 76, serves to adjust the contact pressure between the flywheel 226 and the ram 244. The structure and operation of the adjustment providing spacer 276 is somewhat different than that of the spacer 76, and will be explained in greater detail in a subsequent portion of the specification.

A linkage employing a pair of lever arms 278 and 280 and a U-shaped member 281 (FIGS. 14 and 16) couples the safety yoke 223 to a toggle mechanism 262, and causes the toggle mechanism 262 to be toggled from an open position wherein the ram 244 cannot be engaged to a closed or ram-engaging position when the nosepiece 222 and safety yoke 223 are brought into contact with the workpiece. A spring 282 returns the toggle mechanism to its open position when the tool is disengaged from the workpiece. Thus, the toggle mechanism 262 operates in a similar manner as the toggle mechanism 62 (FIGS. 3 and 6).

Figure 16:
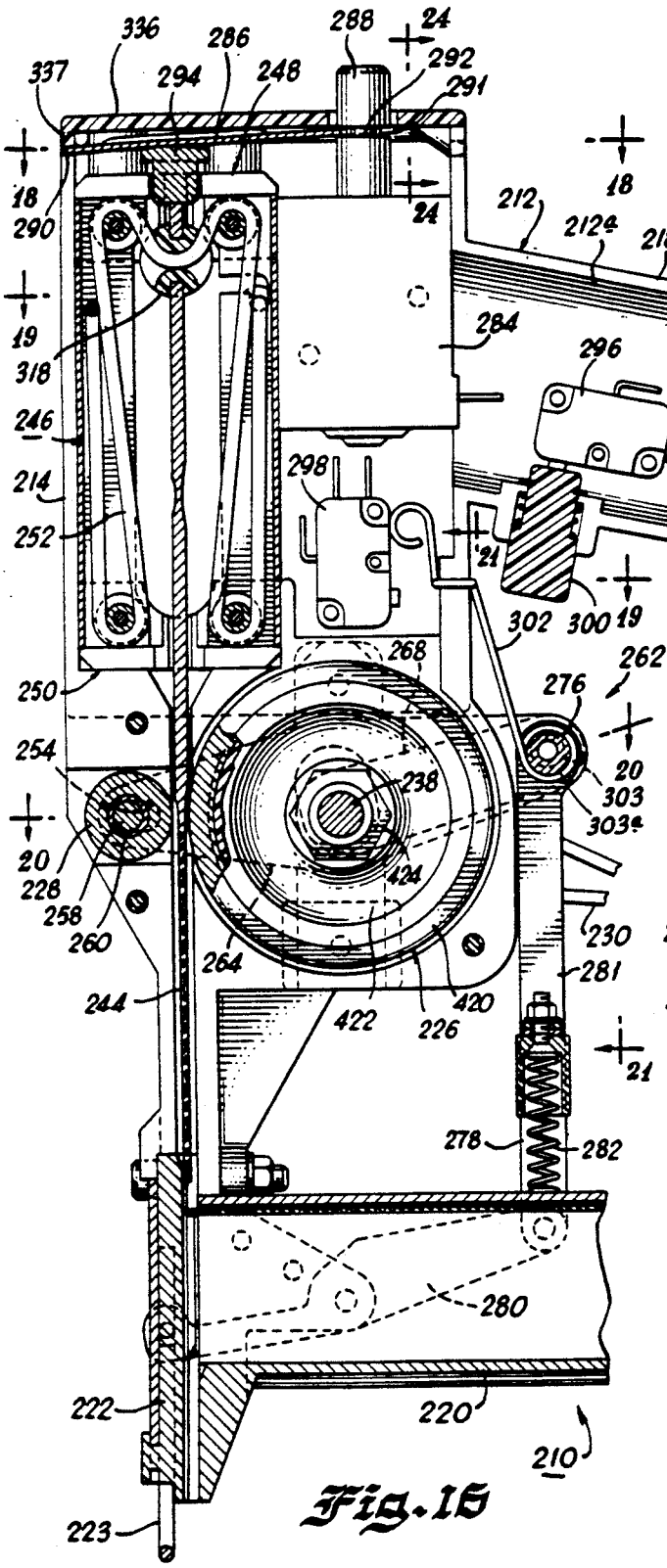
FIG. 16 is a cross sectional view taken along line 16—16 of FIG. 15.
Figure 17:
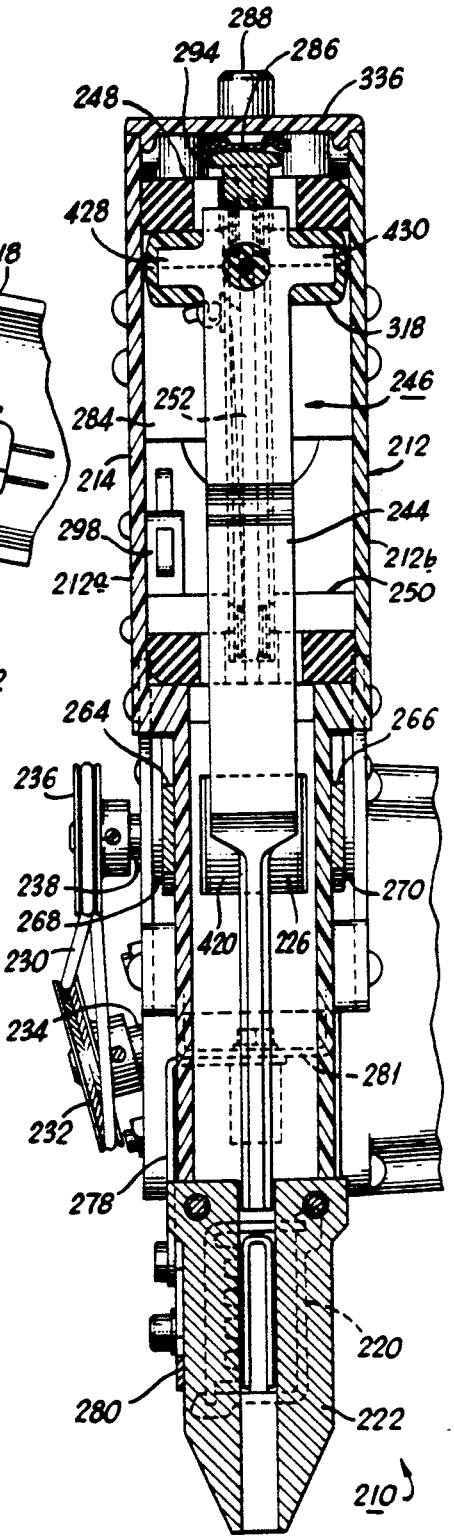
FIG. 17 is a cross sectional view taken along line 17—17 of FIG. 14.

Referring to FIGS. 16 and 17, a solenoid 284 is mounted within the vertical housing 214 and actuates a lever 286 via a solenoid armature 288, and forces the ram 244 down when the solenoid 284 is energized in a manner similar to the operation of the solenoid 84 in the previously-discussed embodiment. The lever 286 has a reduced-width end 290 that is retained in a slot 289 (FIG. 15) of the vertical portion 214 of the housing 212, and a U-shaped notch 291 engages a groove 292 in the solenoid armature 288. A cap 294 mechanically couples the lever 286 to the ram 244. A top cap 336 covers the solenoid assembly and retains the reduced width portion 290 of the lever 286 within the notch 289 by means of a protrusion 337.

A pair of switches 296 and 298 controls the operation of the solenoid 284 with the switch 296 being controlled by a manual push button 300 and the switch 298 being controlled by the safety yoke 223 via the levers 278, 280 and 281 and a wire link 302. In this manner, the operation of the switches 296 and 298 is similar to the operation of the switches 96 and 98 previously described.

The operation of the embodiment illustrated in FIGS. 14–27 is similar to the embodiment illustrated in FIGS. 1–13; however, there are some differences worth noting. These differences include differences in the adjustment mechanism of the toggle mechanism, differences in the construction of the flywheel, and as previously mentioned, the counterrotation of the motor and the flywheel to reduce precessionary forces.

With respect to the differences in the toggle mechanisms, the toggle mechanism 262 is somewhat simpler than the toggle mechanism 62. In the toggle mechanism 262 (best illustrated in FIGS. 19 and 20) the adjustment of the spacing between the flywheel 226 and the idler 228 is also provided by rotating the spacer 276. However, the construction of the spacer 276 (FIG. 22) is somewhat different than the construction of the spacer 76. Firstly, rather than having a series of flats to permit rotation of the spacer, the spacer 276 has a hole 307 drilled through the body of the spacer 276 at right angles to the longitudinal axis of the spacer 276. The hole 307 permits the spacer 276 to be conveniently rotated by inserting a suitable tool such as an ice pick, a scribe, nail or any suitable elongated object into the hole 307 to rotate the spacer 276. In addition, a series of indices 400 are disposed on the spacer 276, and various ones of the indices 400 become aligned with a guide mark 402 disposed on the arm 266 to provide an indication of the adjustment of the spacing between the flywheel 226 and the idler wheel 228. In addition, a plus sign 404 and a minus sign 406 to indicate the appropriate direction of rotation necessary to either increase or decrease the spacing between the flywheel 226 and the idler wheel 228.

Another difference between the spacer 276 and the spacer 76 is the relative position of the eccentric portions. In the spacer 276, the reduced end portions are coaxial with the axis of the spacer 276 and with the threaded holes that receive the screws 272 and 274; however, a pair of eccentric portions 303*a* and 305*a* are provided. The portions 303*a* and 305 *a* are coaxial with each other, but their axis is offset from the axis of the spacer 276 so that they are eccentric with respect to the respective portions 303 and 305. Consequently, when the spacer 276 is rotated, the portions 303*a* and 305*a* move eccentrically about the axis of the spacer 276 to provide the adjustment between the flywheel 226 and the idler wheel 228. This is different from the operation of the spacer 76 wherein the end portions 103 and 105 are eccentric with respect to the body of the spacer 76 and the portions 103*a* and 105*a*; however, it is not important which of the reduced diameter portions is offset from the axis of the spacer, as long as the two reduced diameter end portions are eccentric with respect to each other.

Instead of having a pair of set screws such as the screws 108 and 109 (previously described in conjunction with FIGS. 8 and 9) to hold the spacer in position once the spacing adjustment has been made, the screws 272 and 274 (FIGS. 19 and 20) are used to provide this function. This function is accomplished by making the lengths of the reduced diameter portions 303 and 305 shorter than the thicknesses of the respective arms 268 and 270. Because the reduced diameter portions 303 and 305 are shorter than the thickness of the respective arms 268 and 270, the arms 268 and 270 can be securely wedged between the eccentric portions 303*a* and 305*a* and the heads of the screws 272 and 274 (or washers 408 and 410) when the screws 272 and 274 are tightened. Thus, once the spacing between the idler wheel 228 and the flywheel 226 is adjusted, the setting of the spacer 276 is maintained by simply tightening the screws 272 and 274. As a result, the need for set screws such as the set screws 108 and 109 (FIGS. 8 and 9) is eliminated.

Figures 23, 24, 25, 26, 27:
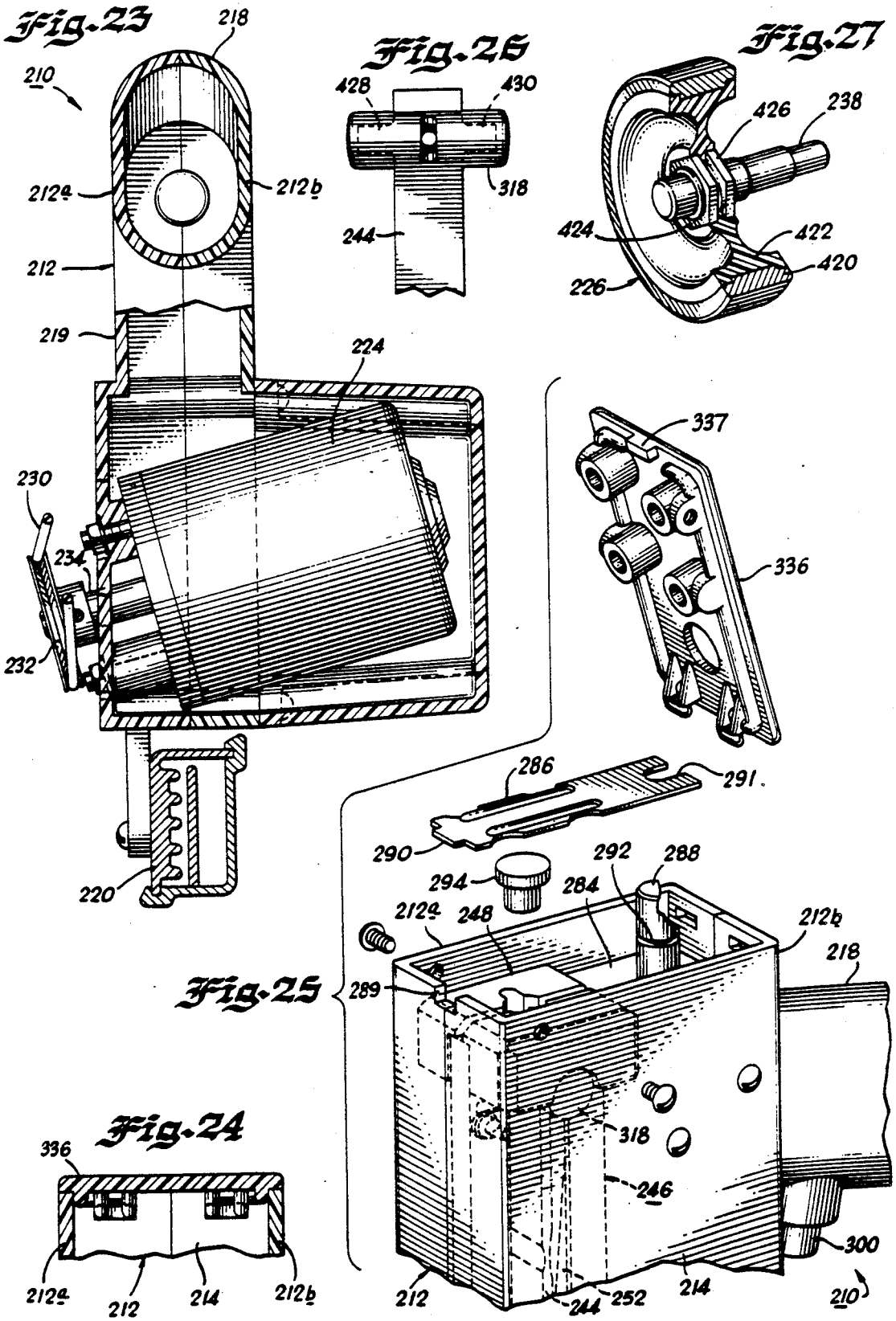
FIG. 23 is a sectional view taken along line 23—23 of FIG. 14 illustrating the canted motor assembly.
FIG. 24 is a sectional view taken along line 24—24 of FIG. 16.
FIG. 25 is an exploded perspective view illustrating the upper portion of the ram housing.
FIG. 26 is a detailed view of the upper portion of the ram assembly.
FIG. 27 is a perspective view, partially in cross section, of the flywheel assembly illustrating the resilient hub of the flywheel.

In accordance with another important aspect of the present invention, the flywheel 226 need not be fabricated as a unitary structure from a single material, but can be fabricated from more than one material. For example, as is illustrated in FIG. 27, the flywheel 226 can have a rim portion 420 fabricated from one material and a hub portion 422 fabricated from another material to provide an optimally designed flywheel. For example, the rim 420 can be fabricated from a relatively heavy, durable material, while the hub portion 422 may be fabricated from a lighter weight, somewhat resilient material such as plastic or nylon. By concentrating the heavier material in the rim 420, a lighter flywheel is obtained. Also, since it is the mass of the material near the rim of the flywheel that contributes most to the amount of energy that can be stored in the flywheel, the reduction in weight is achieved without sacrificing the energy storage capability of the flywheel. Also, the composite flywheel can be of a lower cost of manufacture than an all-steel flywheel since less tool steel and less machining is required.

In addition to reducing the weight and cost of the flywheel, the use of more than one material permits an optimum material to be selected for the rim and hub portions of the flywheel. For example, the material selected for the rim portion 420 can be selected for optimum wear qualities, while the material for the hub 422 can be selected for other qualities, such as weight, compression shear strength, and resiliency. In particular, if the hub portion 422 is fabricated from a hard, but resilient material that is more compressible than the tool steel used to fabricate the rim 420, the adjustment of the spacing between the flywheel 226 and the idler wheel 228 becomes less critical. As a result, the toggle mechanism requires less frequent adjustment as the rim 420 and the ram 244 wear. Suitable materials for the hub include rosite, which is a combination of polyester and approximately 15% fiberglass, hard urethane and other plastics.

Because of the compressibility of the hub 422, when the initial adjustment of the spacing between the flywheel 226 and idler wheel 228 is made, the spacing can be made somewhat narrower than could be tolerated by a system utilizing an all-metal flywheel. This occurs because the hub 422 will deflect enough to permit the ram 244 to pass between the flywheel 226 and idler wheel 228 when the ram 244 is engaged. Because the use of a compressible material for the hub 422 permits a narrower initial setting of the spacing between the flywheel 226 and the idler wheel 228 to be achieved, the system is less susceptible to the effects of wear of the rim 420 and the ram 244. This is because the hub 422 acts as a resilient biasing device that maintains the rim 420 in contact with the ram 244 even though both the rim 420 and the ram 244 become thinner through wear. Finally, although the flywheel 226 is shown to be attached to the shaft 238 by molding the hub 422 over a pair of hexagonally-shaped sections 424 and 426 extending from the shaft 238, it should be understood that the hub 422 could be screwed on or otherwise attached to the shaft 238.

In the embodiment illustrated in FIG. 26, the ram 244 also has a lateral crosspiece or travel limiting stop member 318 affixed thereto. However, to provide a more secure attachment between the stop member 318 and the ram 244, and to reduce the probability of the ram 244 from being dislodged from the stop member 318 at either the upper or lower limit of travel of the ram 244, the ram 244 is provided with a pair of laterally-extending members 428 and 430. The stop member 318 is molded over the laterally extending arms 428 and 430, which prevent the ram 244 from slipping out of the stop member 318 when the stop member 318 impacts the upper bumper 248 or the lower bumper 250.

As previously stated, the fastener driving tool according to the present invention is designed so that a fastener cannot be driven unless the trigger 100 (or 300) is depressed and the yoke 23 (or 223) is in contact with a workpiece. If either one of these conditions is not met, the fastener will not be driven. This function has been achieved in the prior art, such as in U.S. Pat. No. 4,298,072, by simply connecting a trigger controlled switch and a yoke controlled switch in series with the solenoid and the power line so that the solenoid cannot be energized unless both the trigger controlled switch and the yoke controlled switch are closed.

However, when energizing the solenoid, it is desirable to energize the solenoid with a high amplitude current of relatively short and preferably fixed duration. The reason for this is that it is desirable to force the ram between the idler wheel and the flywheel rapidly to assure a proper engagement of the ram, and then rapidly to retract the armature of the solenoid to permit the ram to be returned to its uppermost position without interference from the armature of the solenoid.

Therefore, in accordance with yet another important aspect of the invention, a timing means is provided to generate the desired pulse. For example, it has been found that such a current pulse can be obtained by discharging a capacitor through the solenoid to thereby rapidly energize the solenoid. The capacitor then forms part of a timing circuit or timing means that automatically terminates the energization of the solenoid when the capacitor has discharged.

Several circuits suitable for discharging a capacitor into the solenoid while preventing the solenoid from being energized, unless both the trigger and safety yoke are depressed, are illustrated in FIGS. 28–31. The circuits illustrated in FIGS. 28–31 are shown as controlling the operation of the motor 24 and solenoid 84 via the trigger switch 96 and the yoke controlled switch 98; however, it should be understood that the circuits can also be used to control the motor 224 and solenoid 284 via the switches 296 and 298 as in an alternative embodiment of the present invention.

Figure 28:
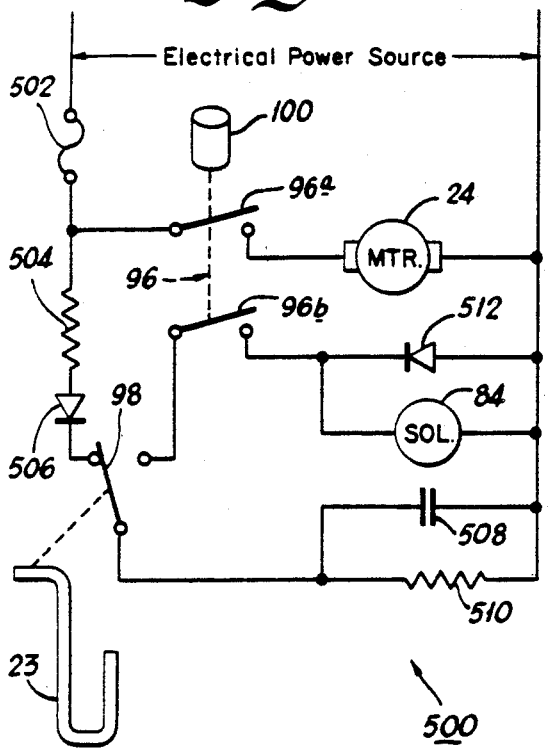
FIGS. 28–31 are schematic diagrams of various electrical circuits suitable for controlling the operation of the solenoid and flywheel driving motor.

In the circuit illustrated in FIG. 28, generally designated by the reference numeral 500, the motor 24 is connected to a source of electrical power via a contact 96*a* of the trigger switch 96 and a fuse 502. Although it is desirable to use an overload protection device, such as the fuse 502, it should be understood that the fuse 502 is not necessary for proper operation of the circuit 500. A charge storage capacitor 508 is also connected to the electrical power source via the yoke operated switch 98, a current limiting resistor 504 and a rectifier diode 506. The capacitor 508 is selectively connected to the solenoid 84 via the yoke controlled switch 98 and a second contact 96*b* of the trigger controlled switch 96. A transient suppressing diode 512 is connected across the terminals of the solenoid 84 to reduce switching transients produced by the inductance of the solenoid 84. A bleeder resistor 510 is connected across the capacitor 508 to discharge the capacitor when the tool is not in use.

In operation, when the trigger 100 is not depressed and the yoke is not in contact with a workpiece, the trigger controlled switch sections 96*a* and 96*b* are open, and the yoke controlled switch 98 is in the position shown in FIG. 28. Consequently, when the tool is plugged into the electrical power source, the capacitor 508 is charged via the fuse 502, the current limiting resistor 504, the diode rectifier 506, and the switch 98. The motor 24 is not energized under these conditions because the trigger controlled switch section 96*a* is open.

When it is desired to drive a fastener into a workpiece, the trigger 100 is depressed, thereby closing the switch sections 96*a* and 96*b*. The closing of the switch section 96*a* energizes the motor 24 to bring the flywheel 126 up to speed. However, the solenoid 84 is not energized until the yoke 23 is brought into contact with the workpiece, at which time the series path between the capacitor 508 and the switch 96*b* is closed via the switch 98, thereby discharging the capacitor 508 into the solenoid 84. This energizes the solenoid 84 and causes the solenoid 84 to drive the ram 44 between the flywheel 26 and the idler wheel 28 to thereby drive the ram 44 into engagement with a fastener. The length of time that the solenoid 84 remains energized is determined by the capacity of the capacitor 508 and the impedance of the coil of the solenoid 84. Thus, the capacitor 508 and the coil of the solenoid 84 act as a timing circuit to determine the length of time that the solenoid 84 will be energized.

After the fastener has been driven, the yoke 23 is lifted from the workpiece, usually as a result of the impact produced by the ram 44, and the armature of the switch 98 is returned to the position shown in FIG. 28. This permits the capacitor 508 to be rapidly recharged so that the next fastener can be driven when the yoke 23 is again placed in contact with the workpiece.

If no further fasteners are to be driven, the trigger 100 is released, thereby opening the switch sections 96*a* and 96*b*. The opening of the switch section 96*a* opens the circuit between the electrical power source and the motor 24, and the opening of the switch section 96*b* opens the circuit between the capacitor 508 and the solenoid 84. The opening of the switch section 96*b* serves as a safety feature to prevent a fastener from being accidentally discharged should the fastening tool be set down on its yoke 23 before the flywheel 26 has come to a complete stop.

Although various size components may be used as the current limiting resistor 504, the charge storage capacitor 508 and the bleeder resistor 510, it has been found that a 100-microfarad capacitor provides a suitable current pulse to energize the solenoid 84, and that the use of an 8-ohm resistor as the current limiting resistor 504 permits the capacitor 508 to be fully recharged between fastener driving cycles without drawing excessive current from the electrical power source. A 47,000 ohm resistor has been found to be suitable for the bleeder resistor 510 since it does not bleed the capacitor 508 between fastener driving cycles, but discharges it within a reasonable period of time after trigger 100 has been released, or after the tool has been disconnected from the electrical power source.

Figure 29:
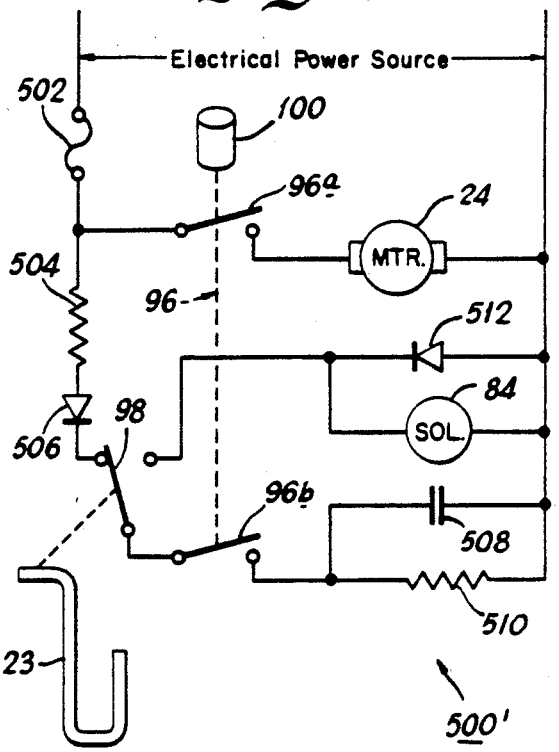

Another embodiment of the control circuit 500 is illustrated in FIG. 29 and designated by the reference numeral 500'. In the control circuit 500', corresponding components have the same reference numeral as their counterparts in FIG. 28. The components and operation of the circuit 500' is substantially the same as that of the circuit 500, with the only exception being that the switch element 96*b* is connected in series between the switch 98 and the capacitor 508, rather than between the switch 98 and the solenoid 84. Thus, the switch 96*b* provides the same safety function as it did in the circuit 500 of FIG. 28 by preventing the capacitor 508 from being discharged into the solenoid 84 when the trigger 100 is not depressed. However, by being interposed between the switch 98 and the capacitor 508, the switch 96*b* permits the capacitor 508 to be charged only when the trigger 100 is depressed. Thus, the capacitor 508 is not maintained in a charged state whenever the tool is plugged into an electrical power source as in the case of the circuit illustrated in FIG. 28.

Figure 30:
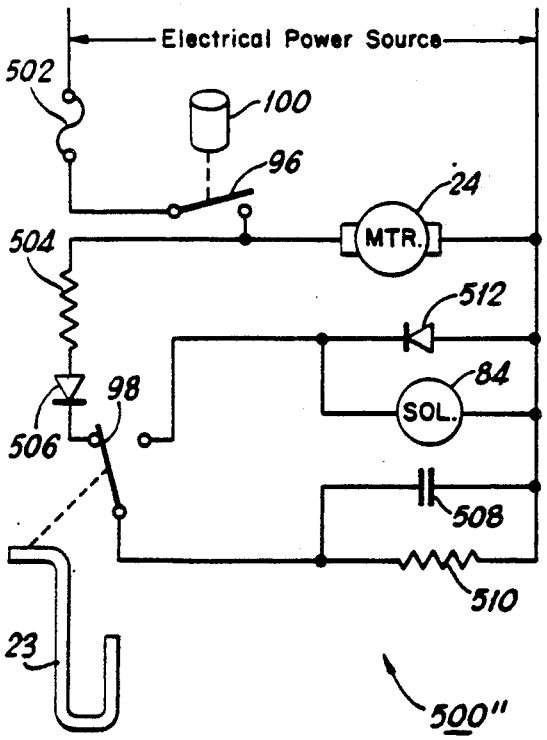

FIG. 30 illustrates another variation, generally designated by the reference numeral 500'', of the circuits 500 and 500' illustrated in FIG. 28 and 29, respectively. The circuit 500'' illustrated in FIG. 30 is a simplified version of the circuit 500' illustrated in FIG. 29, and the same reference numerals are used to identify corresponding components in the two circuits. In the circuit 500'' illustrated in FIG. 30, the trigger-operated switch 96 is a single pole rather than a double pole switch. The single pole switch 96 is used to control both of the operation of the motor 24 and the charging of the capacitor 508. This is achieved by connecting the switch 96 in series with both the motor 24, and via other circuitry, the capacitor 508. The switch 96 is normally open so that when the trigger 100 is not depressed, the motor is deenergized and no charging voltage is applied to capacitor 508. When the trigger 100 is depressed, the switch 96 is closed, thereby energizing the motor 24 and permitting the capacitor 508 to recharge via the switch 96, the current limiting resistor 504, the rectifier diode 506 and the yoke operated switch 98. The capacitor 508 is discharged into the solenoid 84 to effect fastener driving when the yoke 23 is brought into contact with the workpiece, thereby causing the switch 98 to close the circuit between the capacitor 508 and the solenoid 84.

Figure 31:
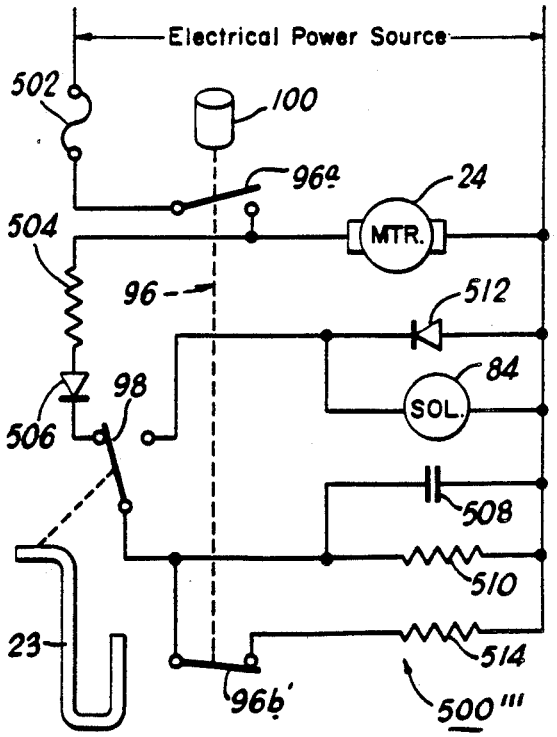

The circuit 500''' illustrated in FIG. 31 is yet another variation of the circuit 500'' illustrated in FIG. 30. The circuit 500''' is similar to the circuit 500'' except that a second switch section 96*b'* is used to connect a discharge resistor 514 across the capacitor 508. The switch section 96*b'* is similar to the switch 96*b* previously discussed except that the switch section 96*b'* is normally closed when the trigger 100 is not depressed. Consequently, when the trigger 100 is not depressed, the discharge resistor 514, which has a value of a few ohms, is maintained connected across the capacitor 508 to maintain the capacitor 508 in a substantially discharged condition. This prevents the capacitor 508 from being accidentally discharged into the solenoid 84 should the yoke 23 inadvertently be brought into contact with an object. Depressing the trigger 100 opens the switch section 196*b'*, and permits the capacitor 508 to be charged through the fuse 502, current limiting resistor 504 and rectifier diode 506, and permits normal operation of the fastener driving tool to take place. The bleeder resistor 510 is not absolutely necessary when the discharge resistor 514 is used, but serves as a safety feature to discharge the capacitor 508 in the event of failure of the switch section 96*b'* or of the resistor 514.

The circuit shown in FIG. 28 can be modified to provide a control circuit in which the tool 10 can be operated by first placing the nosepiece 22 against a workpiece followed by actuation of the trigger switch 96. More specifically, the contacts 96*a* of the trigger switch 96 are shunted or paralleled by a selector switch, such as a slide switch, which is operated to close contacts identical in function to the contacts 96*a* when the tool is to be operated when the pushbutton is to be actuated last. This maintains the motor 24 continuously energized during the tool operating period. The yoke 23 is then placed against the workpiece to operate the switch 98, as described above. When the pushbutton 100 is then operated to close the contacts **96*b*, the solenoid 84 is momentarily operated to actuate the tool 10** as described above.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. In an electric impact tool of the type including a movable impact element adapted to be driven by engagement with a rotating flywheel, the improvement comprising:

a flywheel having a rigid rim and a resilient hub supporting said rim.

2. In a fastener driving tool having an energy storing flywheel, means coupled to said flywheel for effective rotation thereof, an impact element and means for bringing said flywheel into engagement with said impact element, the improvement comprising:

a two-section flywheel having a rim portion and a hub portion, wherein said rim portion is fabricated from metal and said hub portion is fabricated from a nonmetallic material.

3. The improvement recited in claim 2 wherein said rim portion is fabricated from steel.

4. The improvement recited in claim 2 wherein said hub portion is fabricated from plastic.

5. The improvement recited in claim 4 wherein said plastic includes a combination of polyester and fiberglass.

6. The improvement recited in claim 4 wherein said plastic is urethane.

7. In a fastener driving tool having an energy storing flywheel, an axle supporting said flywheel, means coupled to said flywheel for effecting rotation thereof, an impact element and means for bringing said flywheel into engagement with said impact element, the improvement comprising:

a two section flywheel having a rim and means for coaxially supporting said rim about the axle, said supporting means including resilient means for permitting relative motion of the axes of said rim and said axle upon the engagement of said impact element and said rim.

8. The improvement recited in claim 7 wherein said supporting means includes a plastic hub.

9. The improvement recited in claim 8 wherein said rim is fabricated from metal and disposed about the periphery of said plastic hub.

10. The improvement recited in claim 9 wherein said metal is steel.

11. In a fastener driving tool of the type having an energy storing flywheel, means including a motor having a stationary portion and a rotating portion coupled to said flywheel for effecting rotation thereof, an impact element and means for bringing said flywheel into engagement with said impact element, the improvement comprising:

means for compensating for the precessional effects of the rotating flywheel, said compensating means including means for rotating the rotating portion of said motor and said flywheel in opposite directions.

12. The improvement recited in claim 11 wherein said means for rotating in opposite directions includes a pulley coupled to said motor, a pulley coupled to said flywheel and a belt connected between said pulleys.

13. The improvement recited in claim 12 wherein said belt is disposed about said pulleys in a figure-eight configuration.

14. The improvement recited in claim 12 wherein said flywheel has a first axis of rotation and said rotating portion of said motor has a second axis of rotation, wherein said first and second axes of rotation are not parallel to each other.

15. The improvement recited in claim 14 wherein said belt is disposed about said pulleys in a figure-eight configuration.

16. In a fastener driving tool having an energy storing flywheel, means coupled to said flywheel for effecting rotation thereof, a ram and means for bringing said flywheel into engagement with said ram wherein said ram is movable between an upper rest portion and a lower fastener engaging portion, the improvement wherein said ram has a unitary body portion having both a fastener driving end and a flywheel engaging surface, said ram further having a pair of integrally formed members extending laterally from said elongated body portion and a stop member supported by said integrally formed members, and a further improvement including an upper and lower bumper having a recess wherein said stop member in cylindrical in shape molded over said integrally formed members, and said stop member forms a complementary fit with said recess.

17. In a fastener driving tool having an energy storing flywheel, means coupled to said flywheel for effecting rotation thereof, a ram and means for bringing said flywheel into engagement with said ram, wherein said ram is movable between an upper rest portion and a lower fastener engaging portion, the improvement wherein said ram has a unitary body portion having both a fastener driving end and a flywheel engaging surface, said ram fastener having a pair of integrally formed members extending laterally from said elongated body portion and a stop member supported by said integrally formed members wherein said stop member is molded over said integrally formed members and supported thereby.

18. The improvement recited in claim 17 wherein said stop member is fabricated from plastic.

19. A tool for driving fasteners, comprising:

a housing;

a ram mounted for reciprocation between an upper and a lower position;

a flywheel selectively engaging said ram to drive said ram from said upper position to said lower position;

means for supporting said ram within said housing, said supporting means including an upper resilient bumper for limiting the upward travel of said ram and a lower resilient bumper for limiting the downward travel of said ram, and vertical supports interconnecting said upper and lower resilient bumpers, said support means further including an elongated elastic member resiliently supporting said ram in said upper position coupled to said ram, wherein said supporting means, said ram, and said elastic member are insertable into and removable from said housing as a unit;

means for coupling said electric motor to said flywheel to effect rotation of said flywheel; and a battery affixed to said tool and electrically coupled to said motor to selectively energize said motor.

20. A tool for driving fasteners comprising:

a housing;

a ram reciprocably mounted to said housing;

a handle mounted to said housing;

a flywheel mounted near a forward end of said handle in close proximity to said ram;

a motor mounted to said housing and disposed near a rear portion of said handle;

means for effecting engagement between said flywheel and said ram thereby to drive said ram into engagement with a fastener; and means including a resilient member coupling said motor to said flywheel for effecting rotation of said flywheel, whereby the spacing of said flywheel and said motor tends to balance the tool and cooperates with the resilient member to reduce the shock applied to said motor upon the engagement of said ram and said flywheel.

21. A tool as recited in claim 20 further including a battery electrically coupled to said motor disposed within said handle.

* * * * *